US008952863B2

(12) United States Patent
Haque et al.

(10) Patent No.: US 8,952,863 B2
(45) Date of Patent: Feb. 10, 2015

(54) STRAIN-TUNABLE ANTENNA AND ASSOCIATED METHODS

(75) Inventors: Samiul Haque, Cambridge (GB); Richard White, Huntingdon (GB)

(73) Assignee: Nokia Corporation, Espoo (FI)

( * ) Notice: Subject to any disclaimer, the term of this patent is extended or adjusted under 35 U.S.C. 154(b) by 805 days.

(21) Appl. No.: 12/971,072

(22) Filed: Dec. 17, 2010

(65) Prior Publication Data

US 2012/0154248 A1 Jun. 21, 2012

(51) Int. Cl.

| | |
|---|---|
| ***H01Q 1/08*** | (2006.01) |
| ***H01Q 9/04*** | (2006.01) |
| ***H01Q 1/38*** | (2006.01) |
| ***H01Q 3/01*** | (2006.01) |

(52) U.S. Cl.

CPC ..... *H01Q 9/0407* (2013.01); *H01Q 1/38* (2013.01); *H01Q 3/01* (2013.01); *H01Q 9/0442* (2013.01)

USPC ..... 343/880; 343/702; 343/700 MS; 343/846

(58) Field of Classification Search

USPC ..... 343/702, 757, 700 MS, 880, 846, 853, 343/895, 830, 786; 342/368

See application file for complete search history.

(56) References Cited

U.S. PATENT DOCUMENTS

| | | | | |
|---|---|---|---|---|
| 5,210,541 | A * | 5/1993 | Hall et al. | 343/700 MS |
| 6,208,063 | B1 | 3/2001 | Horikawa et al. | |
| 7,671,398 | B2 | 3/2010 | Tran | |
| 2002/0014992 | A1 | 2/2002 | Sun et al. | |
| 2004/0020299 | A1 * | 2/2004 | Freakes et al. | 73/702 |
| 2004/0021098 | A1 * | 2/2004 | Gorinevsky et al. | 250/559.19 |
| 2004/0252069 | A1 | 12/2004 | Rawnick et al. | |
| 2007/0176832 | A1 | 8/2007 | Qian et al. | |
| 2008/0001829 | A1 | 1/2008 | Rahola et al. | |
| 2008/0204338 | A1 * | 8/2008 | Rofougaran | 343/751 |
| 2009/0140938 | A1 * | 6/2009 | Ishibashi et al. | 343/713 |
| 2009/0322646 | A1 | 12/2009 | Dreina et al. | |
| 2010/0127953 | A1 | 5/2010 | Wik | |

FOREIGN PATENT DOCUMENTS

CN 1254986 A 5/2000

OTHER PUBLICATIONS

Notification of Transmittal of the Int'l Search Report and the Written Opinion of the Int'l Searching Authority, Form PCT/ISA/220 mailed Jan. 13, 2012, for Int'l Appl'n No. PCT/FI2011/050765, 1 page.

Int'l Search Report, Form PCT/ISA/210, for Int'l Appl'n No. PCT/FI2011/050765, 5 pages.

Written Opinion of the Int'l Searching Aithority, Form PCT/ISA/237, for Int'l Appl'n No. PCT/FI2011/050765, 7 pages.

Xi Chen et al, "1.6 V Nanogenerator for Mechanical Energy Harvesting Using PZT Nanofibers," May 25, 2010, Nano Letters, 10, 2133-2137 (5 pages).

J.E. Huger et al, "The selection of mechanical actuators based on performance indices," Department of Engineering, Cambridge University, Proc. R. Soc. Lond. A, 1997, 453, 2185-2205 (21 pages).

Office Action for Chinese Application No. 2011800603997 dated May 5, 2014.

* cited by examiner

*Primary Examiner* — Sue A Purvis
*Assistant Examiner* — Jae Kim
(74) *Attorney, Agent, or Firm* — Alston & Bird LLP

(57) ABSTRACT

An apparatus comprising an actuating substrate and an antenna in contact with the actuating substrate, the actuating substrate configured to undergo strain during actuation, wherein the strain in the actuating substrate varies the dimensions of the in-contact antenna and causes a change in the operational characteristics of the antenna.

13 Claims, 7 Drawing Sheets

STRAIN-TUNABLE ANTENNA AND ASSOCIATED METHODS

TECHNICAL FIELD

The present disclosure relates to the field of RF antennas, associated methods and apparatus, and in particular concerns a strain-tunable antenna comprising an actuator for controlling the size and operational frequency of the antenna. Certain disclosed example aspects/embodiments relate to portable electronic devices, in particular, so-called hand-portable electronic devices which may be hand-held in use (although they may be placed in a cradle in use). Such hand-portable electronic devices include so-called Personal Digital Assistants (PDAs).

The portable electronic devices/apparatus according to one or more disclosed example aspects/embodiments may provide one or more audio/text/video communication functions (e.g. tele-communication, video-communication, and/or text transmission, Short Message Service (SMS)/Multimedia Message Service (MMS)/emailing functions, interactive/non-interactive viewing functions (e.g. web-browsing, navigation, TV/program viewing functions), music recording/playing functions (e.g. MP3 or other format and/or (FM/AM) radio broadcast recording/playing), downloading/sending of data functions, image capture function (e.g. using a (e.g. in-built) digital camera), and gaming functions.

BACKGROUND

The design of antennas in high frequency electronics for mobile communication has been a key factor in the development of ultrafast communication technologies. Modern electronic devices allow users to communicate with other devices using a number of different wireless technologies. The antennas for use with these technologies often require different operational parameters (e.g. input impedance, gain, directivity, signal polarization, resonant frequency, bandwidth and radiation pattern).

The properties of antennas are dependent upon the size, shape and material composition of the antenna elements, the interaction between elements, the relationship between certain antenna physical parameters (e.g. length for a linear antenna and diameter for a loop antenna), and the wavelength of the signal received or transmitted by the antenna. To enable communication using multiple different technologies, some modern electronic devices incorporate separate antennas for each technology, whilst others use a tunable antenna which allows the antenna properties to be modified. Tunable antennas are becoming more and more popular given the increasingly limited space available within the casing of electronic devices.

Tunable antennas are also being used in cognitive radio devices. In order to avoid interference, these devices are required to transmit signals only on frequencies which are not currently being used by other users of the electromagnetic spectrum. Since the available frequencies vary over time, cognitive radio devices must be able to alter the operational parameters of their antennas to satisfy this requirement.

A number of different techniques can be used to modify the operational parameters of a tunable antenna. The apparatus and methods disclosed herein may or may not provide an alternative technique.

The listing or discussion of a prior-published document or any background in this specification should not necessarily be taken as an acknowledgement that the document or background is part of the state of the art or is common general knowledge. One or more aspects/embodiments of the present disclosure may or may not address one or more of the background issues.

SUMMARY

According to a first aspect, there is provided an apparatus comprising an actuating substrate and an antenna in contact with the actuating substrate, the actuating substrate configured to undergo strain during actuation, wherein the strain in the actuating substrate varies the dimensions of the in-contact antenna and causes a change in the operational characteristics of the antenna.

The term "contact" may be taken to include "physical contact" between the antenna and the actuating substrate.

The actuating substrate may be configured for one or more of mechanical (e.g. bending and/or stretching), thermal, and piezoelectric actuation. The actuating substrate may be a flexible and/or stretchable substrate. The actuating substrate and/or antenna may be optically transparent. The actuating substrate may be configured to undergo one or more of tensile, compressive, volume, and shearing strain. The actuating substrate may comprise polydimethylsiloxane (PDMS).

The apparatus may comprise a heating element. The apparatus may be configured such that the heating element increases the temperature of the actuating substrate to thereby cause physical strain in the actuating substrate via thermal expansion. The actuating substrate may comprise a membrane. The antenna and/or heating element may be located on or within the membrane. The heating element may comprise an electrically conducting material (such as gold or copper). One or more of the actuating substrate, antenna and heating element may be reversibly strainable.

The actuating substrate may comprise a piezoelectric material, such as lead zirconate titanate (PZT) or polyvinylidene fluoride (PVDF). The piezoelectric material may be configured to undergo physical strain when exposed to an applied electric field. The electric field may be generated by one or more electrode pairs. Each electrode pair may comprise first and second electrodes of opposite polarity. The electric field may be generated by an array of interdigitated electrodes configured to induce uniaxial strain in the piezoelectric material. The electric field may be generated by concentric circular electrodes configured to induce radial strain in the piezoelectric material.

The piezoelectric material may comprise one or more piezoelectric nanostructures (such as nanowires, nanotubes or nanofibers). The piezoelectric material may comprise a plurality of piezoelectric nanostructures arranged such that the applied electric field is capable of inducing a non-zero net strain in the piezoelectric material. The piezoelectric nanostructures may not be in physical contact with either of the first or second electrodes. The piezoelectric nanostructures may be coated with an electrically insulating material.

The antenna may comprise one or more electrically conducting nanostructures (such as nanowires, nanotubes or nanofibers). The nanostructures may comprise silver. The antenna may comprise one or more electrically conducting planar structures. The planar structures may comprise graphene or graphene-based materials (e.g. pure or doped graphene sheets). The antenna may comprise an interpenetrating matrix of electrically conducting nanostructures. The antenna may comprise a mesh of electrically conducting material (such as gold or copper). The antenna may be located on or within the actuating substrate. The antenna may be configured to transmit and/or receive electromagnetic signals. The antenna may be configured to transmit and/or receive one or more of the following (i.e. have one or more operational frequencies associated with): radio frequency, Wi-Fi™, Bluetooth™, infrared, and cellular signals. The change in antenna dimensions may be configured to cause a change in the operational frequency and/or input impedance of the antenna. The antenna may be a microstrip antenna.

The apparatus may comprise two or more antennas. The two or more antennas may be located on a common surface of the actuating substrate. The two or more antennas may be located on different (e.g. opposing) surfaces of the actuating substrate. At least two of the two or more antennas may have different dimensions under the same actuation conditions. The apparatus may comprise two or more individually addressable antennas. The actuating substrate may be divided into two or more independently strainable cells.

Each cell may be configured to vary the dimensions of a respective individually addressable antenna. At least two of the two or more antennas may be configured to transmit and/or receive different frequencies of electromagnetic signal.

The apparatus may further comprise a processor and memory including computer program code, the memory and computer program code configured to, with the processor, set the operational characteristics of the antenna by controlling actuation of the actuating substrate.

According to a further aspect, there is provided a device comprising any apparatus described herein. The device may be one or more of the following: a transmitter, a receiver, a transceiver, an electronic device, a portable electronic device, a portable telecommunications device, a cognitive radio device, and a module for any of the aforementioned devices.

According to a further aspect, there is provided a method for making an apparatus, the method comprising:

providing an actuating substrate; and providing an antenna in contact with the actuating substrate, the actuating substrate configured to undergo strain during actuation, wherein the strain in the actuating substrate varies the dimensions of the in-contact antenna and causes a change in the operational characteristics of the antenna.

The actuating substrate may be provided by depositing an elastomeric material (e.g. PDMS) on top of a supporting substrate (e.g. a semiconducting substrate comprising silicon or Kapton™). The antenna may be provided by depositing an electrically conductive material on top of the actuating substrate using a printing process. The method may comprise functionalising the actuating substrate (e.g. using oxygen plasma) before depositing the electrically conductive antenna material. Deposition may be performed using evaporation or sputtering techniques.

The method may further comprise the following steps before deposition of the electrically conductive antenna material: depositing an electrically conductive material on top of the elastomeric material to form a heating element; and depositing a layer of elastomeric material (e.g. PDMS) between the heating element and the antenna.

The method may further comprise removing some of the elastomeric material between the supporting substrate and the heating element (e.g. by etching or developing the elastomeric material) to form a membrane. The method may comprise providing one or more electrode pairs, each electrode pair comprising first and second electrodes of opposite polarity.

According to a further aspect, there is provided a method for changing the operational characteristics of an antenna, the method comprising:

providing an apparatus, the apparatus comprising an actuating substrate and an antenna in contact with the actuating substrate, the actuating substrate configured to undergo strain during actuation, wherein the strain in the actuating substrate varies the dimensions of the in-contact antenna and causes a change in the operational characteristics of the antenna; and actuating the actuating substrate.

The steps of any method disclosed herein do not have to be performed in the exact order disclosed, unless explicitly stated or understood by the skilled person.

According to a further aspect, there is provided a computer program, recorded on a carrier, the computer program comprising computer code configured to perform any method described herein.

The apparatus may comprise a processor configured to process the code of the computer program. The processor may be a microprocessor, including an Application Specific Integrated Circuit (ASIC).

The present disclosure includes one or more corresponding aspects, example embodiments or features in isolation or in various combinations whether or not specifically stated (including claimed) in that combination or in isolation. Corresponding means for performing one or more of the discussed functions are also within the present disclosure.

Corresponding computer programs for implementing one or more of the methods disclosed are also within the present disclosure and encompassed by one or more of the described example embodiments.

The above summary is intended to be merely exemplary and non-limiting.

BRIEF DESCRIPTION OF THE FIGURES

A description is now given, by way of example only, with reference to the accompanying drawings, in which:—

DESCRIPTION OF SPECIFIC ASPECTS/EMBODIMENTS

An antenna is a transducer which transmits and/or receives electromagnetic waves, and comprises an arrangement of one or more electrical conductors (usually called "elements"). During transmission, an alternating current is created in the elements by applying a voltage at the antenna terminals, causing the elements to radiate an electromagnetic field. During reception, an electromagnetic field from another source induces an alternating current in the elements and a corresponding voltage at the antenna terminals.

Several critical parameters affect an antenna's performance and can be adjusted during the design process. These include resonant frequency, impedance, antenna gain, radiation pattern, polarization, efficiency, and bandwidth. Transmission antennas may also have a maximum power rating, whilst receiving antennas differ in their noise reduction properties.

Figure 1A:
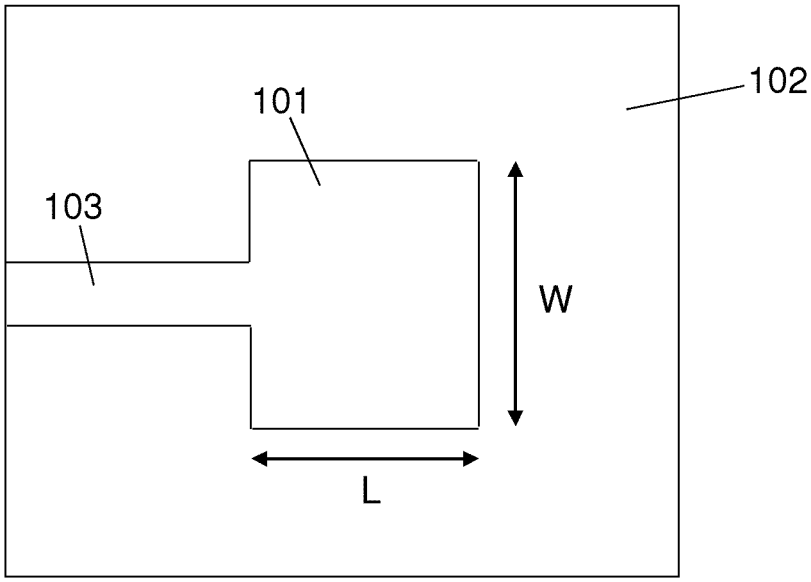
FIG. 1*a* shows a patch antenna in plan view (prior art)
Figure 1B:
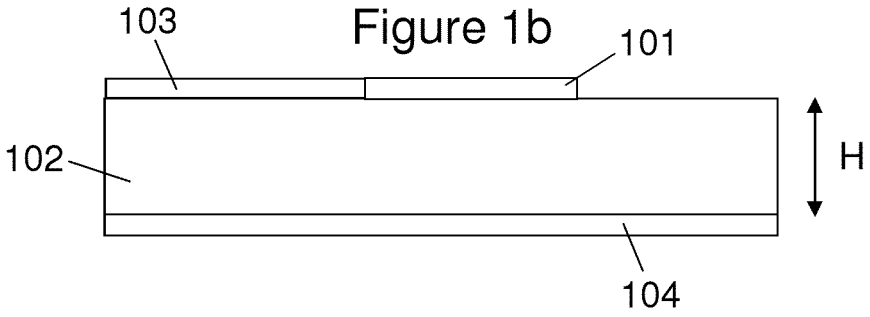
FIG. 1*b* shows a patch antenna in side view (prior art)

Many modern RF devices incorporate microstrip (or patch) antennas. Unlike the wire antennas of older devices, for example retractable or non-retractable external helices, monopoles or whip antennas, microstrip antennas can be fabricated directly onto circuit boards. A standard microstrip antenna produces linearly polarized electromagnetic fields, and is shown in plan view and side view in FIGS. 1*a* and 1*b*, respectively.

Microstrip antennas are usually fabricated on top of a dielectric substrate 102 of thickness, H, and comprise a planar antenna element 101 which is fed by a narrow (microstrip) transmission line 103. The antenna element 101 and transmission line 103 are usually made from a high conductivity metal. The bottom surface of the substrate 102 is coated with a continuous layer of high conductivity metal to form the ground plane 104. The thickness of the ground plane 104, antenna element 101 and transmission line 103 is not critically important, but the thickness of the dielectric substrate 102 is typically much smaller than the wavelength of operation.

The length (L) and width (W) of the antenna element 101 determine the resonant frequency and input impedance, respectively. The centre frequency, $f_c$, of the microstrip antenna is given (approximately) by $$f_c = \frac{c}{2L\sqrt{\varepsilon_r}} = \frac{1}{2L\sqrt{\varepsilon_0\varepsilon_r\mu_0}} \qquad \text{Equation 1}$$

where c is the speed of light, $\in_r$ is the relative permittivity of the dielectric substrate, $\in_o$ is the permittivity of free space, and $\mu_o$ is the permeability of free space. This equation implies that the microstrip antenna should have a length equal to one half of a wavelength within the dielectric substrate. The input impedance of the antenna can be reduced by increasing the width, but many antennas tend to be compensated by circuits to avoid using a wide patch.

Figure 2A:
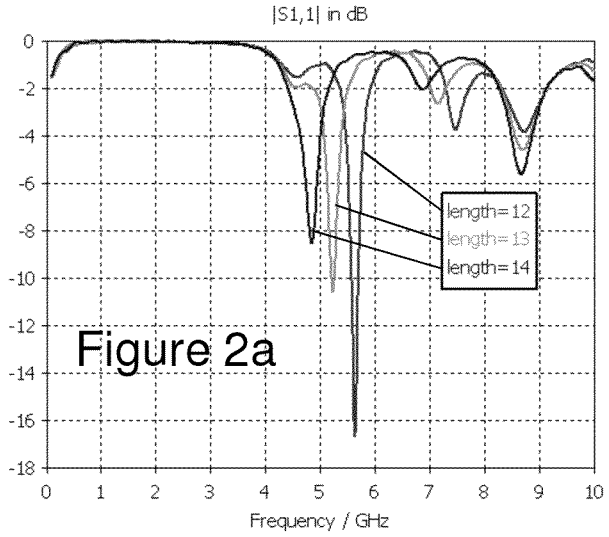
FIG. 2*a* shows the simulated variation in resonant frequency when the antenna length is varied from 12 mm to 14 mm (present disclosure)
Figure 2B:
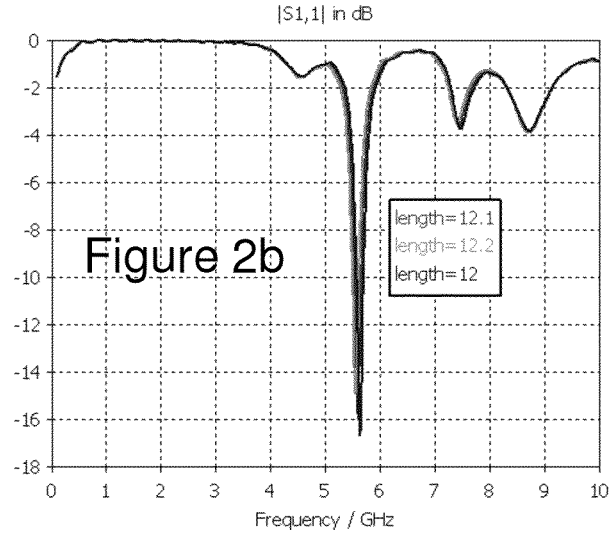
FIG. 2*b* shows the simulated variation in resonant frequency when the antenna length is varied from 12.0 mm to 12.2 mm (present disclosure)
Figure 2C:
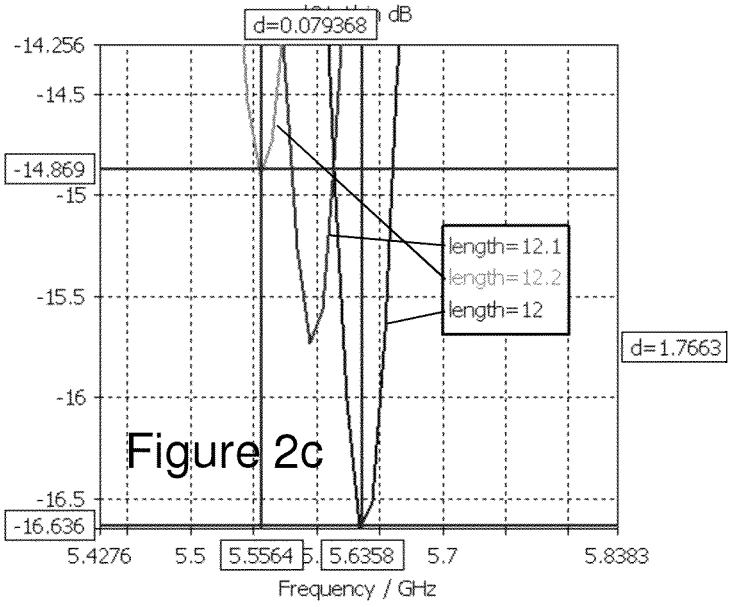
FIG. 2*c* shows more detail of the centre frequency shift in FIG. 2*b* (present disclosure)

Simulated data in FIGS. 2*a*-2*c* show how the operational frequency of a microstrip antenna varies with antenna length. In FIG. 2*a*, the centre frequency changes from 5.8 GHz to 4.8 GHz as the length of the antenna is varied from 12 mm to 14 mm. These simulations show that a variation of as much as 0.1 GHz can be achieved with a 1-2% change in length. This is illustrated in FIGS. 2*b* and 2*c*, where the length of the antenna was varied from 12 mm to 12.2 mm. It is possible to vary the centre frequency by up to several GHz with even greater changes in length using the current geometry, and it may be possible to achieve even larger frequency shifts using different geometries of antenna (such as PIFA antennas or circular antennas, for example). Strains greater than 50% are possible using mechanical actuation (i.e. physically bending or stretching the sample) rather than thermal and piezoelectric actuation (see later). In general, thermal and piezoelectric actuation is capable of stretching the antenna by up to a few %, whilst mechanical actuation can result in larger strains.

Up until recently, the components of electronic devices have been fabricated on rigid circuit boards. At present, however, many devices incorporate flexible or rigid-flex circuit boards. The flexibility of these circuit boards provides manufacturers with greater design freedom; an important consideration as devices decrease further in size. The present disclosure takes advantage of these flexible and/or stretchable substrates for varying antenna dimensions and controlling their operational parameters.

Figure 3A:
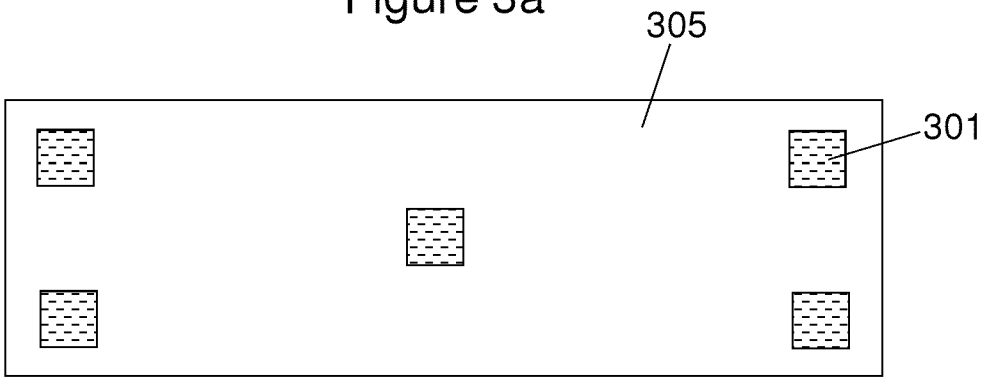
FIG. 3*a* shows a strain-tunable antenna configured for mechanical actuation in an unstrained state (present disclosure)
Figure 3B:
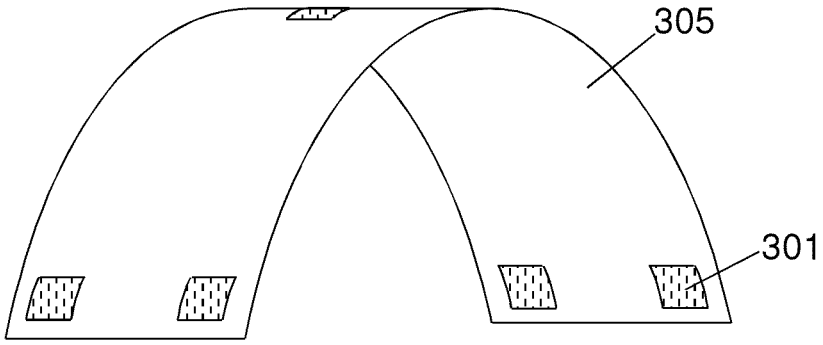
FIG. 3*b* shows a strain-tunable antenna configured for mechanical actuation in a strained state (present disclosure)

FIG. 3*a* shows a first embodiment of the present disclosure. In this embodiment, one or more antennas 301 are formed on or within a flexible and/or stretchable substrate 305, referred to herein as an "actuating substrate". The actuating substrate 305 itself is configured to undergo physical strain (reversible deformation) when a force is applied to bend and/or stretch the material (i.e. mechanical actuation puts the actuating substrate 305 under mechanical stress). The physical strain may be tensile, compressive, volume or shearing strain. The antennas 301 are also formed from a reversibly deformable material. Since the antennas 301 are in contact (i.e. physically coupled) with the actuating substrate, the dimensions (length, width or thickness) of the antennas 301 are varied when the actuating substrate 305 is bent or stretched, as shown in FIG. 3*b*. As discussed above, such variations in dimensions can be used to change the operational characteristics of the antennas 301. If the variations in antenna dimensions are calibrated with changes in the operational characteristics, this feature may be used to reproducibly control the antenna parameters using mechanical actuation.

Being able to control the centre frequency with antenna length may be particularly advantageous. As discussed in the background section, tunable antennas are required for cognitive radio devices. The present apparatus could therefore be used instead of the tunable antennas currently used in cognitive radio devices. The apparatus may also be useful in any electronic device that communicates with external devices using multiple communication technologies (such as radio frequency, Wi-Fi™, Bluetooth™, infrared, or cellular). In these situations, the apparatus could effectively replace the plurality of fixed antennas typically provided in modern electronic devices, thereby allowing further device miniaturisation and increasing design freedom.

Other potential uses of the present apparatus are strain sensing and shape detection. For example, if the variations in antenna length and centre frequency were calibrated, it would be possible to determine the length of an antenna 301 by measuring the centre frequency (e.g. using RFID technology) of a transmitted electromagnetic signal. In effect, therefore, measurements of the centre frequency could be used to provide strain information. Strain information can be useful in construction and electronic packaging.

Shape detection, on the other hand, would require a plurality of antennas 301 distributed over the various surfaces of, or within the volume of, the actuating substrate 305. In this way, by determining the length of each antenna 301 from frequency measurements, a two-dimensional or three-dimensional image of the substrate 305 could be calculated. This aspect could be of use in joint flexure sensing applications, such as in sports training, sports therapy, or even gaming applications. In such applications, the user would be required to wear the material 305 during a physical activity to monitor his/her physical form.

One suitable material for forming the actuating substrate 305 is polydimethylsiloxane (PMDS), which can undergo at least 20% strain without deleterious effects. The antennas 301 on the other hand, may be formed from any electrically conducting material that can undergo reversible deformation. Each antenna 301 may comprise an interpenetrating matrix of electrically conducting nanostructures, or a mesh of electrically conducting material. For example, each antenna 301 may comprise a two-dimensional network of silver nanowires. The actuating substrate 305 and antennas 301 may also be optically transparent. This feature is mainly for aesthetic reasons, but also acts to increase the design freedom by allowing the antenna structure to be integrated on or within an electronic display or other visible device component without any adverse optical impact. An optical transparency of 88-92% can be achieved using silver nanowires.

Actuation of the actuating substrate may be performed thermally rather than by simply applying mechanical force. This embodiment is shown schematically in FIG. 4*a*, and comprises a heating element 406 configured to increase the temperature of the actuating substrate 405 and induce physical strain in the substrate 405 via thermal expansion. Elastomers typically exhibit high thermal expansion coefficients (TECs), and can withstand high operating temperatures. For example, PMDS has a TEC of 330 ppm/K and has a maximum operating temperature of 150° C. Using PMDS as the actuating substrate 405 therefore, an increase in temperature of 100° C. causes a relative increase in volume of ~0.033. Assuming isotropic expansion, the change in volume is given by $$\frac{dV}{V} = \left(\frac{dL}{L+1}\right)^3 - 1 \qquad \text{Equation 2}$$

where V and L are the volume and length of the actuating substrate, respectively. This equates to an approximate strain of 1.08% in all dimensions. It is possible to mix various elastomers with different molecular weights together to make different grades of elastomer which can expand more than PMDS.

Figure 4A:
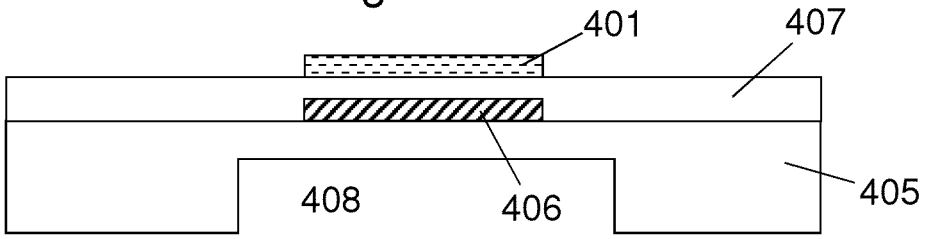
FIG. 4*a* shows a strain-tunable antenna configured for thermal actuation in cross-section (present disclosure)

In the embodiment shown in FIG. 4*a*, a membrane 407 is formed in the actuating substrate 405 to thermally isolate the heating element 406 from the surrounding material. In this way, heat produced by the heating element 406 can be concentrated towards the antenna 401, instead of dissipating through the adjacent substrate material. Removal of the adjacent substrate material 408 may be performed by back etching or partially developing the elastomer. Since the membrane 407 is made from the same elastomer as the bulk of the actuating substrate 405, the risk of breakage is minimised as a result of its inherent flexibility (which can be a major issue in MEMS design).

Figure 4B:
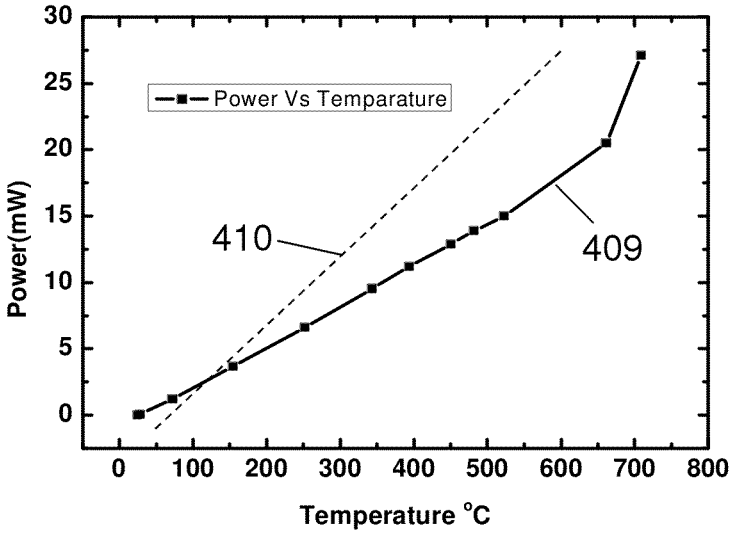
FIG. 4*b* shows how the power required by the embedded heater varies with temperature; (present disclosure)
Figure 4C:
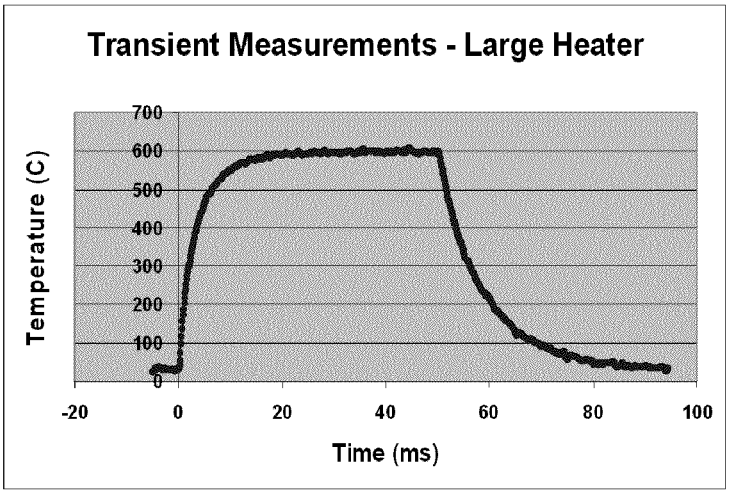
FIG. 4*c* shows how the temperature of the embedded heater varies with time during a heating and subsequent cooling cycle; (present disclosure)

The heating element 406 may be formed from any electrically and thermally conducting material which can undergo resistive heating (such as gold or copper), and may comprise one or more nanowires. The heating element may also be reversibly flexible and/or stretchable to allow it to conform to the changing dimensions of the actuating substrate 405. Heating experiments were performed using heating elements 406 made from copper wires with radii of 500 μm (409) and 1 mm (410). These experiments have shown that temperatures of up to 500° C. can be achieved with power requirements of ~20 mW (FIG. 4*b*). The change in temperature over time during a heating and cooling cycle of the 500 μm element is shown in FIG. 4*c*. This graph shows that the temperature of the heating element 406 can be increased from 30-600° C. in ~20 ms by passing an electrical current through the wire. Once the flow of current was stopped, the temperature dropped back down to 30° C. in ~80 ms. A thermal response like this allows the heating element 406 to be pulsed rapidly for expanding and contracting the actuating substrate 405 whilst minimising the overall power consumption.

Piezoelectric actuation is another possible way of controlling the dimensions of the actuating substrate and antenna. In this embodiment, the actuating substrate comprises a piezoelectric material configured to undergo physical strain when exposed to an applied DC electric field. The piezoelectric material may comprise one or more piezoelectric nanostructures, and the electric field may be generated by one or more electrode pairs, each comprising first and second electrodes of opposite polarity.

Figure 5A:
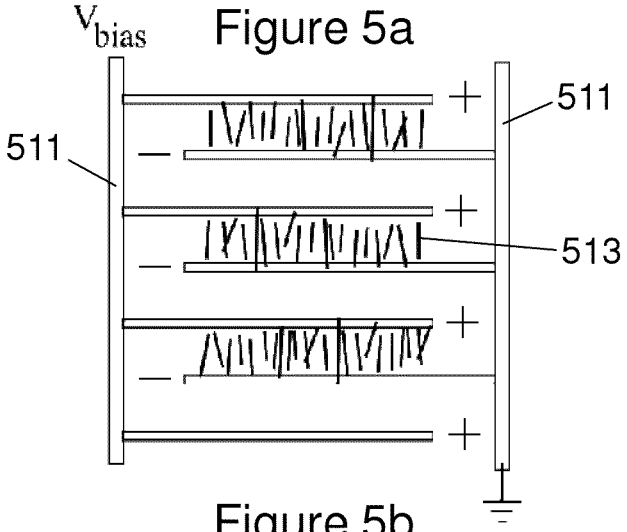
FIG. 5*a* shows a strain-tunable antenna configured for uniaxial piezoelectric actuation (present disclosure)
Figure 5B:
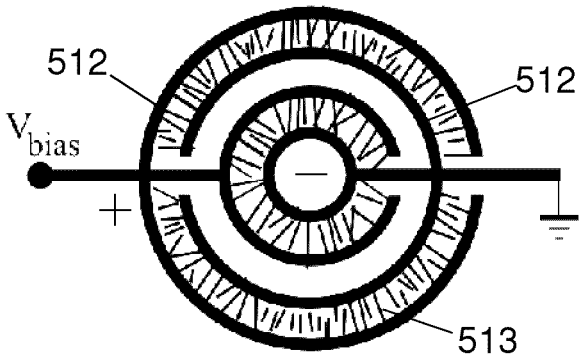
FIG. 5*b* shows a strain-tunable antenna configured for radial piezoelectric actuation (present disclosure)

Two different electrode configurations are shown in FIGS. 5*a* and 5*b*. In FIG. 5*a*, the electric field is generated by an array of interdigitated electrodes 511 configured to induce uniaxial strain in the piezoelectric material, whilst in FIG. 5*b*, the electric field is generated by concentric circular electrodes 512 configured to induce radial strain in the piezoelectric material. In both configurations, the piezoelectric nanostructures 513 are arranged between every second electrode gap. This arrangement helps to ensure that a non-zero net strain is induced in the piezoelectric material when the electric field is applied. If the nanostructures 513 were arranged between every electrode gap, adjacent electrode pairs would apply opposite forces on the material, thereby resulting in a reduced (possibly zero) net actuation. Alignment of the piezoelectric nanostructures 513 may be achieved using dielectrophoresis or other nanowire assembly methods.

It is important to note that no (or minimum) current should flow between the electrodes 511, 512 via the piezoelectric nanostructures 513. Free charges in a piezoelectric material 513 screen the applied electric field and reduce displacement of the material. Furthermore, current flow through the nanostructures 513 increases power consumption in the device, which is undesirable. The piezoelectric nanostructures 513 may be coated in an electrically insulating material to prevent the flow of current in the event that any of the nanostructures 513 happen to be in physical contact with both the first and second electrodes of an electrode pair.

The piezoelectric nanostructures 513 may comprise lead zirconate titanate (PZT) or polyvinylidene fluoride (PVDF), both of which have high piezoelectric coefficients. Whilst PVDF has piezoelectric coefficients which are two orders of magnitude less than PZT, the maximum actuation strain of PVDF is 0.3% compared with 0.1% for PZT. This demonstrates that limitations associated with the maximum tolerable field strength set stringent upper bounds on achievable strain values.

Figure 5C:
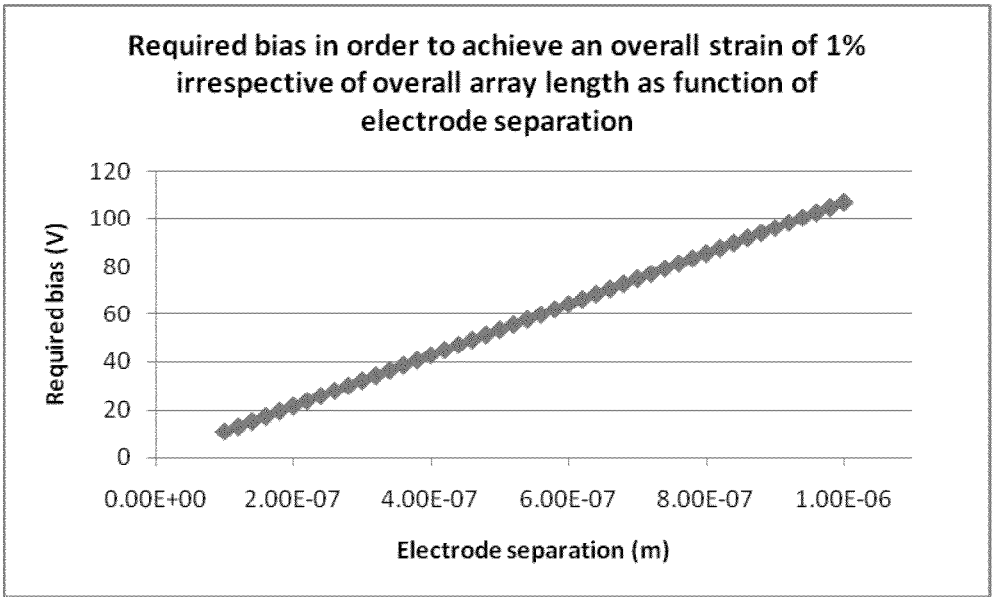
FIG. 5*c* shows how the potential difference required to achieve 1% strain varies with electrode separation (present disclosure)

FIG. 5*c* shows how the potential difference, $V_{bias}$, required to achieve 1% strain in PZT varies with electrode separation. The potential difference was calculated using $$V_{bias} = \frac{4SL}{d} \quad \text{Equation 3}$$

where S is the strain, L is the electrode separation and d is the piezoelectric constant for PZT in the axial direction. As can be seen from the graph, $V_{bias}$ scales linearly as the electrode separation, is increased. A practical potential difference of ~20V corresponds with an electrode separation of 200 nm.

Strains of ≤1% (achievable using piezoelectric actuation) are limiting in terms of frequency modulation. To address this situation, one option might be to fabricate an array of (at least two) independently addressable antennas having different dimensions under the same actuation conditions. With this configuration, each size of antenna could be used to transmit and/or receive a different frequency of signal, whilst the array as a whole could cover the complete frequency range used by modern radio standards (300 MHz-5.8 GHz). In some embodiments, different sizes of antenna may be used to transmit and/or receive one or more different types of signal (such as radio frequency, Wi-Fi™, Bluetooth™, infrared, or cellular signals), possibly in parallel. The actuating substrate may be divided into two or more independently strainable cells, each configured to vary the dimensions of a respective antenna. Of course, not every antenna in the array needs to be individually addressable, and not every antenna in the array needs to be of a different size. In addition, multiple antennas may be actuated by a common strainable cell at the same time. The array of antennas could also be controlled using mechanical or thermal actuation rather than piezoelectric actuation.

Figure 6:
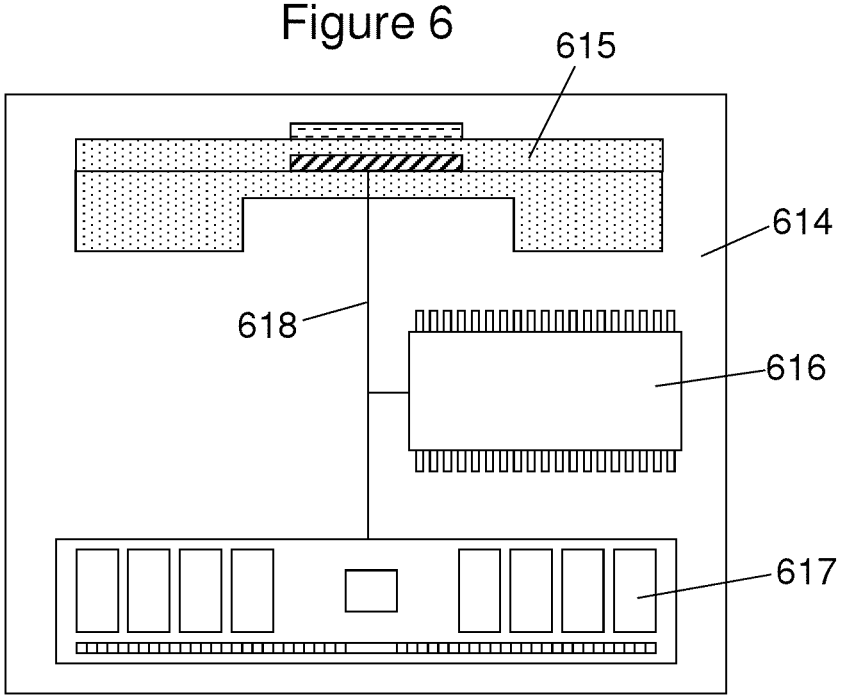
FIG. 6 shows an apparatus comprising the strain-tunable antenna described herein (present disclosure)

FIG. 6 illustrates schematically a device 614 comprising the apparatus 615 described herein. The device 614 also comprises a processor 616, and a storage medium 617, which may be electrically connected to one another by a data bus 618. The device 614 may be a transmitter, a receiver, a transceiver, an electronic device, a portable electronic device, a portable telecommunications device, a cognitive radio device, or a module for any of the aforementioned devices.

The apparatus 615 is configured to transmit and/or receive electromagnetic signals of a particular frequency depending upon the amount of mechanical stress applied to the antenna by the actuating substrate. As described previously, the stress may be applied using mechanical, thermal or piezoelectric actuation, and the resulting strain on the antenna is configured to cause a change in the operational characteristics (e.g. one or more of the input impedance, gain, directivity, signal polarization, bandwidth and radiation pattern). The apparatus 615 may comprise two or more antenna elements configured to transmit and/or receive different frequencies of electromagnetic signal. Each antenna element may be configured to transmit and/or receive one or more of radio frequency, Wi-Fi™, Bluetooth™, infrared and cellular signals.

Detection of the frequency of signal transmitted from or received by the antenna(s) may be used to provide information on the amount of stress/strain experienced by the apparatus 615. Such information may be useful in construction or electronic packaging. Detection of the frequency of signal transmitted from or received by the antenna(s) may also be used to provide information on the two-dimensional or three-dimensional shape of the apparatus 615. Such information may be useful for joint flexure sensing in sports training, sports therapy, or gaming applications.

The processor 616 is configured for general operation of the device 614 by providing signalling to, and receiving signalling from, the other device components to manage their operation. The processor 616 may also be configured to control actuation of the actuating substrate. In the thermal actuation embodiment, the processor 616 is used to control power to the heating element, and therefore controls the temperature and thermal expansion/contraction of the actuating substrate. In the piezoelectric embodiment, the processor 616 is used to control power to the electrodes, and therefore controls the applied electric field and piezoelectric expansion/contraction of the actuating substrate.

The storage medium 617 is configured to store computer code configured to perform, control or enable the making and/or operation of the device 614, as described with reference to FIG. 9. The storage medium 617 may also be configured to store settings for the other device components. The processor 616 may access the storage medium 617 to retrieve the component settings in order to manage the operation of the other device components. In particular, the storage medium 617 may comprise a list of power settings for the heating element and/or electrodes in order to obtain specific antenna dimensions and hence operational characteristics. The storage medium 617 may be a temporary storage medium such as a volatile random access memory. On the other hand, the storage medium 617 may be a permanent storage medium such as a hard disk drive, a flash memory, or a non-volatile random access memory.

Figure 7:
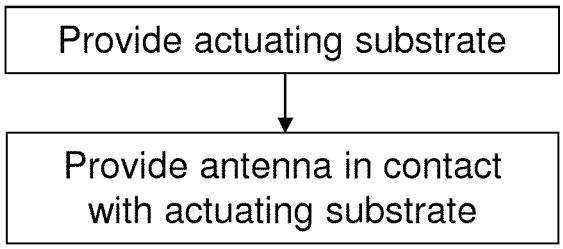
FIG. 7 shows a method of making the strain-tunable antenna described herein (present disclosure)
Figure 8:
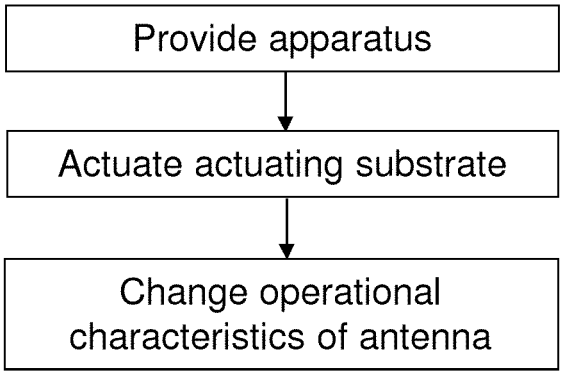
FIG. 8 shows a method of using the strain-tunable antenna described herein (present disclosure)

The main steps of the method used to make the apparatus 615 are illustrated schematically in FIG. 7. Likewise, the main steps of the method used to operate the apparatus 615 are illustrated schematically in FIG. 8.

Fabrication of the apparatus 615 may be performed by depositing an elastomeric material to form the actuating substrate, and depositing/patterning an electrically conductive material on top of the actuating substrate to form the antenna. The elastomeric material may be deposited on top of a supporting substrate (silicon wafer or Kapton™). Furthermore, the elastomeric material may need to be functionalised (e.g. using an oxygen plasma) before the electrically conductive material is deposited. Oxygen plasma is used to produce silane groups, which helps in the adhesion of silver nanowires which may be used to form the antenna. Deposition of any metal described herein may be performed using evaporation, sputter coating or printing. Deposition of any elastomeric or polymeric materials (actuating substrate or piezoelectric material) may be performed using chemical vapour deposition, spin coating or printing.

For thermal actuation, the heating element must also be incorporated. This may be achieved by depositing/patterning (between deposition of the actuating substrate and antenna material) an electrically conductive material on top of the elastomeric material to form the heating element, and depositing a layer of elastomeric material between the heating element and antenna to prevent the flow of electrical current therebetween. To form the membrane, some of the elastomeric material between the supporting substrate and heating element (i.e. below the heating element) may be removed using any subtractive process (e.g. etching or development of the elastomer).

For piezoelectric actuation, the actuating substrate must comprise a piezoelectric material. In this embodiment, it is also necessary to fabricate electrodes for generating the DC electric field. This may be achieved by depositing/patterning an electrically conductive material on top of the elastomeric material to form the electrodes. The electrode structure may or may not be coupled with the antenna structure. Given that the potential difference applied to the electrode structure is DC and the potential difference applied to the antenna structure is AC, electromagnetic interference should be minimal.

Figure 9:
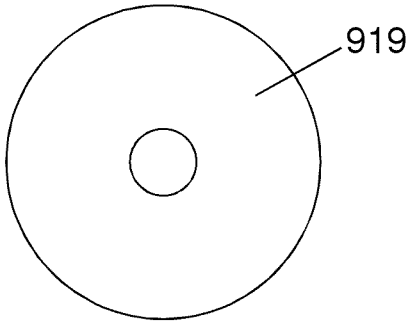
FIG. 9 shows a computer readable medium providing a program for controlling the making and/or use of the strain-tunable antenna described herein (present disclosure).

FIG. 9 illustrates schematically a computer/processor readable medium 919 providing a computer program according to one embodiment. In this example, the computer/processor readable medium 919 is a disc such as a digital versatile disc (DVD) or a compact disc (CD). In other embodiments, the computer/processor readable medium 919 may be any medium that has been programmed in such a way as to carry out an inventive function. The computer/processor readable medium 919 may be a removable memory device such as a memory stick or memory card (SD, mini SD or micro SD).

The computer program may comprise computer code configured to perform, control or enable one or more of the following: provision of an actuating substrate; and provision of an antenna in physical contact with the actuating substrate, the actuating substrate configured to undergo strain during actuation, wherein the strain in the actuating substrate is configured to vary the dimensions of the antenna and cause a change in the operational characteristics of the antenna.

The computer program may also be configured to perform, control or enable one or more of the following: provision of an apparatus, the apparatus comprising an actuating substrate and an antenna in physical contact with the actuating substrate, the actuating substrate configured to undergo strain during actuation, wherein the strain in the actuating substrate is configured to vary the dimensions of the antenna and cause a change in the operational characteristics of the antenna; and actuation of the actuating substrate.

Other embodiments depicted in the figures have been provided with reference numerals that correspond to similar features of earlier described embodiments. For example, feature number 1 can also correspond to numbers 101, 201, 301 etc. These numbered features may appear in the figures but may not have been directly referred to within the description of these particular embodiments. These have still been provided in the figures to aid understanding of the further embodiments, particularly in relation to the features of similar earlier described embodiments.

It will be appreciated to the skilled reader that any mentioned apparatus/device/server and/or other features of particular mentioned apparatus/device/server may be provided by apparatus arranged such that they become configured to carry out the desired operations only when enabled, e.g. switched on, or the like. In such cases, they may not necessarily have the appropriate software loaded into the active memory in the non-enabled (e.g. switched off state) and only load the appropriate software in the enabled (e.g. on state). The apparatus may comprise hardware circuitry and/or firmware. The apparatus may comprise software loaded onto memory. Such software/computer programs may be recorded on the same memory/processor/functional units and/or on one or more memories/processors/functional units.

In some embodiments, a particular mentioned apparatus/device/server may be pre-programmed with the appropriate software to carry out desired operations, and wherein the appropriate software can be enabled for use by a user downloading a "key", for example, to unlock/enable the software and its associated functionality. Advantages associated with such embodiments can include a reduced requirement to download data when further functionality is required for a device, and this can be useful in examples where a device is perceived to have sufficient capacity to store such pre-programmed software for functionality that may not be enabled by a user.

It will be appreciated that any mentioned apparatus/circuitry/elements/processor may have other functions in addition to the mentioned functions, and that these functions may be performed by the same apparatus/circuitry/elements/processor. One or more disclosed aspects may encompass the electronic distribution of associated computer programs and computer programs (which may be source/transport encoded) recorded on an appropriate carrier (e.g. memory, signal).

It will be appreciated that any "computer" described herein can comprise a collection of one or more individual processors/processing elements that may or may not be located on the same circuit board, or the same region/position of a circuit board or even the same device. In some embodiments one or more of any mentioned processors may be distributed over a plurality of devices. The same or different processor/processing elements may perform one or more functions described herein.

It will be appreciated that the term "signalling" may refer to one or more signals transmitted as a series of transmitted and/or received signals. The series of signals may comprise one, two, three, four or even more individual signal components or distinct signals to make up said signalling. Some or all of these individual signals may be transmitted/received simultaneously, in sequence, and/or such that they temporally overlap one another.

With reference to any discussion of any mentioned computer and/or processor and memory (e.g. including ROM, CD-ROM etc), these may comprise a computer processor, Application Specific Integrated Circuit (ASIC), field-programmable gate array (FPGA), and/or other hardware components that have been programmed in such a way to carry out the inventive function.

The applicant hereby discloses in isolation each individual feature described herein and any combination of two or more such features, to the extent that such features or combinations are capable of being carried out based on the present specification as a whole, in the light of the common general knowledge of a person skilled in the art, irrespective of whether such features or combinations of features solve any problems disclosed herein, and without limitation to the scope of the claims. The applicant indicates that the disclosed aspects/embodiments may consist of any such individual feature or combination of features. In view of the foregoing description it will be evident to a person skilled in the art that various modifications may be made within the scope of the disclosure.

While there have been shown and described and pointed out fundamental novel features as applied to different embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment may be incorporated in any other disclosed or described or suggested form or embodiment as a general matter of design choice. Furthermore, in the claims means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

The invention claimed is:

1. An apparatus comprising:

an actuating substrate comprising a piezoelectric material configured to undergo physical strain during actuation when exposed to an electric field;

an antenna in contact with the actuating substrate, wherein the strain in the actuating substrate varies the dimensions or shape of the in-contact antenna and causes a change in the operational characteristics of the antenna, wherein the operational characteristics of the antenna are indicative of the dimensions or shape of the apparatus;

and a processor and memory including computer program code, the memory and computer program code configured to, with the processor, set the operational characteristics of the antenna by controlling actuation of the actuating substrate, wherein controlling the actuating substrate comprises:

generating an electric field in an array of interdigitated electrodes causing uniaxial strain in the piezoelectric material or generating an electric field in concentric circular electrodes causing radial strain in the piezoelectric material.

2. The apparatus of claim 1, wherein the antenna comprises an interpenetrating matrix of electrically conducting nanostructures, one or more electrically conducting planar structures, or a mesh of electrically conducting material.

3. The apparatus of claim 1, wherein the actuating substrate or antenna is optically transparent.

4. The apparatus of claim 1, wherein the apparatus comprises two or more antennas, at least two of the two or more antennas having different dimensions under the same actuation conditions.

5. The apparatus of claim 1, wherein the apparatus comprises two or more individually addressable antennas.

6. The apparatus of claim 5, wherein the actuating substrate is divided into two or more independently strainable cells, each cell configured to vary the dimensions of a respective individually addressable antenna.

7. The apparatus of claim 1, wherein the antenna is configured to transmit and/or receive one or more of the following: radio frequency, Wi-Fi™, Bluetooth™, infrared, and cellular signals.

8. The apparatus of claim 1, wherein the change in antenna dimensions is configured to cause a change in the operational frequency and/or input impedance of the antenna.

9. A device comprising the apparatus of claim 1.

10. A method for making an apparatus, the method comprising: providing an actuating substrate comprising a piezoelectric material configured to undergo physical strain during when exposed to an electric field;

providing an antenna in contact with the actuating substrate, wherein the strain in the actuating substrate varies the dimensions or shape of the in-contact antenna and causes a change in the operational characteristics of the antenna, wherein the operational characteristics of the antenna are indicative of the dimensions or shape of the apparatus;

and providing a processor and memory including computer program code, the memory and computer program code configured to, with the processor, set the operational characteristics of the antenna by controlling actuation of the actuating substrate, wherein controlling the actuating substrate comprises:

generating an electric field in an array of interdigitated electrodes causing uniaxial strain in the piezoelectric material or generating an electric field in concentric circular electrodes causing radial strain in the piezoelectric material.

11. A method for changing the operational characteristics of an antenna, the method comprising: providing an apparatus, the apparatus comprising: an actuating substrate comprising a piezoelectric material configured to undergo physical strain during actuation when exposed to an electric field; an antenna in contact with the actuating substrate, wherein the strain in the actuating substrate varies the dimensions or shape of the in-contact antenna and causes a change in the operational characteristics of the antenna, wherein the operational characteristics of the antenna are indicative of the dimensions or shape of the apparatus;

a processor and memory including computer program code, the memory and computer program code configured to, with the processor, set the operational characteristics of the antenna by controlling actuation of the actuating substrate, wherein controlling the actuating substrate comprises:

generating an electric field in an array of interdigitated electrodes causing uniaxial strain in the piezoelectric material or generating an electric field in concentric circular electrodes causing radial strain in the piezoelectric material; and actuating the actuating substrate.

12. A non-transitory computer readable medium comprising computer program code stored thereon, the computer program computer code configured to perform the method of claim 10.

13. A non-transitory computer readable medium comprising computer program code recorded thereon configured to perform the method of claim 11.

* * * * *